US008896516B2

(12) United States Patent
Honbo

(10) Patent No.: US 8,896,516 B2
(45) Date of Patent: Nov. 25, 2014

(54) LIGHT EMISSION CONTROL CIRCUIT, LIGHT EMISSION CONTROL METHOD, FLAT ILLUMINATING DEVICE, AND LIQUID CRYSTAL DISPLAY DEVICE HAVING THE SAME DEVICE

(75) Inventor: Nobuaki Honbo, Kanagawa (JP)

(73) Assignee: NLT Technologies, Ltd., Kanagawa (JP)

( * ) Notice: Subject to any disclaimer, the term of this patent is extended or adjusted under 35 U.S.C. 154(b) by 1357 days.

(21) Appl. No.: 12/167,832

(22) Filed: Jul. 3, 2008

(65) Prior Publication Data

US 2009/0015759 A1 Jan. 15, 2009

(30) Foreign Application Priority Data

Jul. 6, 2007 (JP) ..... 2007-179090

(51) Int. Cl.
*G09G 3/36* (2006.01)
*H05B 33/08* (2006.01)

(52) U.S. Cl.
CPC ..... *H05B 33/0815* (2013.01)
USPC ..... 345/102

(58) Field of Classification Search
USPC ..... 345/102
See application file for complete search history.

(56) References Cited

U.S. PATENT DOCUMENTS

| | | | | |
|---|---|---|---|---|
| 7,317,403 | B2 * | 1/2008 | Grootes et al. | 345/102 |
| 2004/0100463 | A1 * | 5/2004 | Miyagawa et al. | 345/212 |

FOREIGN PATENT DOCUMENTS

| | | | | |
|---|---|---|---|---|
| JP | 63-226079 | A | | 9/1988 |
| JP | 6-2391 | U | | 1/1994 |
| JP | 11-068161 | A | | 3/1999 |
| JP | 2001-215913 | A | | 8/2001 |
| JP | 2002-244103 | A | | 8/2002 |
| JP | 2003-152224 | A | | 5/2003 |
| JP | 2004-519826 | A | | 7/2004 |
| JP | 2004-330927 | A | | 11/2004 |
| JP | 2006-66776 | A | | 3/2006 |
| JP | 2006-278252 | A | | 10/2006 |
| JP | 2006-284859 | A | | 10/2006 |
| JP | 2006-303214 | A | | 11/2006 |
| JP | 2007-005014 | A | | 1/2007 |
| JP | 2007005014 | A | * | 1/2007 |
| JP | 2007-165001 | A | | 6/2007 |
| JP | 2007165001 | A | * | 6/2007 |
| WO | 02/076150 | A1 | | 9/2002 |

OTHER PUBLICATIONS

Japanese Office Action dated Feb. 14, 2012 issued in a Japanese Patent Application No. 2007-179090.
Chinese Office Action issued Apr. 23, 2012 in corresponding Chinese Patent Application No. 200810135607.5.

* cited by examiner

*Primary Examiner* — Waseem Moorad
(74) *Attorney, Agent, or Firm* — Sughrue Mion, PLLC

(57) ABSTRACT

There is provided a light emission control circuit being capable of simplifying a power source circuit reducing costs and power consumption. A constant current circuit is serially connected to a specified light emitting device group out of a plurality of light emitting device groups and a power source circuit supplies power to each light emitting device group and a current detecting unit detects a current flowing through a specified light emitting device group and a power control unit controls a power source circuit based on a pre-set current value and on a detected value.

11 Claims, 12 Drawing Sheets

LIGHT EMISSION CONTROL CIRCUIT, LIGHT EMISSION CONTROL METHOD, FLAT ILLUMINATING DEVICE, AND LIQUID CRYSTAL DISPLAY DEVICE HAVING THE SAME DEVICE

INCORPORATION BY REFERENCE

This application is based upon and claims the benefit of priority from Japanese Patent Application No. 2007-179090, filed on Jul. 6, 2007, the disclosure of which is incorporated herein in its entirely by reference.

BACKGROUND OF THE INVENTION

1. Field of the Invention

The present invention relates to a light emission control circuit, light emission control method, flat illuminating device, and liquid crystal display device equipped with the flat illuminating device and more particularly to the light emission control circuit, light emission control method, flat illuminating device, and liquid crystal display device equipped with the flat illuminating device, which are configured to control driving of a light source made up of a light emitting device such as an LED (light-emitting diode).

2. Description of the Related Art

Conventionally, a display device using a CRT (Cathode Ray Tube) has been used for displaying images, for example, in personal computers, television sets, or a like, however, in recent years, instead of such a display device, a liquid crystal display (LCD) device has become more commonly used. Since a liquid crystal panel is non-luminous, a backlight device is placed on a rear side of the liquid crystal panel and images are displayed by changing optical transmittance of the liquid crystal panel.

As a light source for the liquid crystal display device, from a viewpoint of considerations for environmental problems, mercury (mercury vapor) cannot be used and, therefore, in addition to the CRT, a light emitting device such as an LED is employed. As a result, by using, e.g., red LED(s), green LED(s), or blue LED(s), not only luminance but also chromaticity can be adjusted. That is, it is possible to widen a range of color reproduction (that is, chromaticity region).

The light emission intensity of an LED changes. Therefore, technology has been proposed in which, when driving of a plurality of LEDs is requested, the plurality of LEDs is connected in series to one another and an amount of currents flowing through each of the LEDs is made equal. Incidentally, in the case of the LEDs, a forward voltage to be applied has to be changed so as to correspond to a current to be supplied and, in order to increase a current value, it is necessary that the forward voltage is made higher.

As shown in FIG. 10, a related technology is disclosed in which, in a boost-type DC/DC (Direct Current/Direct Current) converter circuit 101, a plurality of LEDs 102*a*, 102*a*, . . . making up an LED group 102 is connected serially to one another, a resistor 103 is connected to a cathode side of the LED group 102 and a control circuit 104 is configured to switch ON or OFF a semiconductor switch 105 so that a voltage across the resistor 103 is made equal to a reference voltage and so that an output voltage is stabilized and a predetermined constant current is supplied to the LED group 102 (for example, see Japanese Patent Reference 1 (Japanese Patent Application Laid-open No. 2002-244103) or a like).

In more detail, the DC/DC converter circuit 101 is made up of the control circuit 104, an inductor 107 connected to a positive terminal of a DC power source 106, a capacitor 108 connected in parallel to the DC power source 106, a diode 109, the semiconductor switch 105 connected in parallel to the DC power source 106 and the inductor 107, and a capacitor 111 connected in parallel to the diode 109 and the semiconductor switch 105.

Moreover, the DC/DC converter circuit 101 is turned ON/OFF at a specified duty ratio and a voltage is outputted at a boosted level relative to a power voltage Va. However, the conventional technology presents a problem in that, in the case of using, as a light source, three kinds of LEDs (red LED, green LED, and blue LED), three sets of circuits to supply a constant current, which causes the configurations of a power source circuit to be made large-scaled, thus causing a rise in costs. In the case of the backlight device of a large-sized liquid crystal display device and a large number of LEDs is used, if a voltage boosting circuit or control circuit for every color is to be mounted, it causes the circuit to be large-scaled, which leads to an increase in costs.

Also, another related technology is disclosed in which an LED display device separately has, as shown in FIG. 11, a power source 202 to drive a light emission device group 201 made of LEDs and a power source 204 to drive a control circuit 203 and, further, a plurality of (a plurality of pairs of) LEDs 201*a* and 201*b* connected, in parallel to the power source 202 (for example, see Patent Reference 2 (Japanese Utility Model Laid-open No. Hei 06-002391) or a like).

Each of the LEDs 201*a* and each of the LEDs 201*b* make up a pair. An anode side of the LEDs 201*b* are connected in parallel to each switching element 205 and are time-division driven. Cathode terminals of the LEDs 201*a* are connected to one another and cathode terminals of the LEDs 201*a* and LED 201*b* are connected to a constant current circuit 206 being driven according to a display signal. That is, to each of the switching elements 205 are connected pairs of LEDs 201*a* and LEDs 201*b* and to the constant circuit 206 are connected two sets of the LED group.

However, the conventional technology has also problems. That is, when this conventional technology is applied to a backlight device, a forward voltage changes depending on a current fed to each of the LEDs 201*a* and, as a result, when there is a difference between currents $If_1$ and $If_2$ flowing from two sets of the LED group, current consumption wastefully increases.

For example, as shown in FIG. 12, a voltage VL applied by the power source 202 is the sum of voltages V1 (Va1, Vb1), V2 (Va2, Vb2), and V3 (va3, Vb3) to be applied respectively to the switching element 205, the LED 201*a* (LED 201*b*) and the constant current circuit 206. However, the voltage to be applied to the switching element 205 varies greatly depending on whether the current $|If_1|$($|If_2|$)to be fed to the LED 201*a* (LED 201*b*) is comparatively large (that is, when VL=Va1+Va2+Va3) or whether the current $|If_1|$($|If_2|$) is comparatively small (that is, when VL=Vb1+Vb2+Vb3).

That is, even when the current $|If_1|$($|If_2|$) is comparatively small, a voltage Vb1 to be applied to the switching element 205 becomes large by an amount of a voltage Vb2 [increment ΔV (=Vb1−Va1)] to be applied to the LED 201*a* (LED 201*b*) and power is wastefully consumed in the switching element 205.

Further, still another related technology is disclosed in which a constant current circuit is connected to a cathode terminal of each of LEDs and, when a power voltage is lowered, an LED having the highest forward voltage, out of LEDs being in operation, is detected based on a voltage of the constant current circuit and the power voltage is boosted up to a predetermined voltage so as to correspond to the forward voltage to supply the boosted voltage to each of the LEDs (for example, see Patent Reference 3 (Japanese Patent Application No. 2006-066776) or a like).

Further, still another related technology is disclosed in which a plurality of light emitting units each made up of LEDs of three colors and a switch is connected to each of the LEDs and a constant voltage circuit is mounted on every light emitting device and each LED is driven by either of a simultaneous light emitting method or a field sequential driving method to mix colors (for example, see Patent Reference 4 (Japanese Patent Application Laid-open No. 2006-278252) or a like).

Incidentally, still another related technology is disclosed in which, in a display panel using, as a light emitting device, an organic EL (electroluminescence) device, by letting a feeble current flow through the organic EL, a forward voltage appearing at this point of time and, based on the forward voltage, a forward voltage appearing when a predetermined light emission driving current is supplied to the organic EL is estimated to set an output voltage of a power source circuit (for example, see Patent Reference 5 (Japanese Patent Application Laid-open No. 2006-284859) or a like). However, in the Patent References 3, 4, and 5 a constant current circuit is provided, for example, in every LED or in every light emitting unit (light emitting device), which causes an increase in power consumption.

Therefore, the problem to be solved is that the above conventional technology causes a power source circuit to become large-scaled, which leads to an increase in costs and in power consumption.

SUMMARY OF THE INVENTION

In view of the above, it is an exemplary object of the present invention to provide a light emission control circuit capable of simplifying a power source circuit and reducing costs and power consumption, a light emission control method using the above circuit, a flat illuminating device, and a liquid crystal display device equipped with the flat illuminating device.

According to a first exemplary aspect of the present invention, there is provided a light emission control circuit for driving and controlling a light source having a plurality of light emitting device groups connected in parallel to one another each being made up of a plurality of light emitting devices connected serially to one another, the light emission control circuit including:

a power source circuit to supply power to each of the plurality of light emitting device groups;

a current detecting unit to detect a current to be supplied to a specified light emitting device group out of the plurality of light emitting device groups.

According to a second exemplary aspect of the present invention, there is provided a light emission control method for driving and controlling a light source having a plurality of light emitting device groups connected in parallel to one another each being made up of a plurality of light emitting devices connected serially to one another, the light emission control circuit including:

a power supplying step of supplying power to each of the plurality of light emitting device groups;

a current detecting step of detecting a current to be supplied to a specified light emitting device group out of the plurality of light emitting device groups; and a power source controlling step of controlling the power source circuit based on a current detected by the current detecting unit and a current set in advance.

According to a second exemplary aspect of the present invention, there is provided a flat illuminating device including:

a light source having a plurality of light emitting device groups connected in parallel to one another each being made up of a plurality of light emitting devices connected serially to one another; and a light emission control circuit to drive and control the light source;

wherein the light emission control circuit includes a current detecting unit to detect a current to be supplied to a specified light emitting device group out of the plurality of light emitting device groups and a power source controlling unit to control the power source circuit based on a current detected by the current detecting unit and a current set in advance.

According to a third exemplary aspect of the present invention, there is provided a liquid crystal display device including:

a liquid crystal display panel;

a light source having a plurality of light emitting device groups connected in parallel to one another each being made up of a plurality of light emitting devices connected serially to one another; and a flat illuminating device including a light emission control circuit to drive and control the light source;

wherein the light emission control circuit includes a current detecting unit to detect a current to be supplied to a specified light emitting device group out of the plurality of light emitting device groups and a power source controlling unit to control the power source circuit based on a current detected by the current detecting unit and a current set in advance.

BRIEF DESCRIPTION OF THE DRAWINGS

The above and other objects, advantages, and features of the present invention will be more apparent from the following description taken in conjunction with the accompanying drawings in which.

DETAILED DESCRIPTION OF THE PREFERRED EXEMPLARY EMBODIMENTS

Best modes of carrying out the present invention will be described in further detail using various exemplary embodiments with reference to the accompanying drawings. According to the exemplary embodiments, a specified light emitting device group out of a plurality of light emitting device groups is serially connected the constant current circuit and a power supply circuit supplies power to each of the light emitting device groups and a current detecting unit detects a current flowing through the specified light emitting device group and the power control unit controls the power source circuit based on a preset current unit and detected current value, which enables simplification of the power source circuit and reduction in costs and power consumption.

First Exemplary Embodiment

Figure 1:
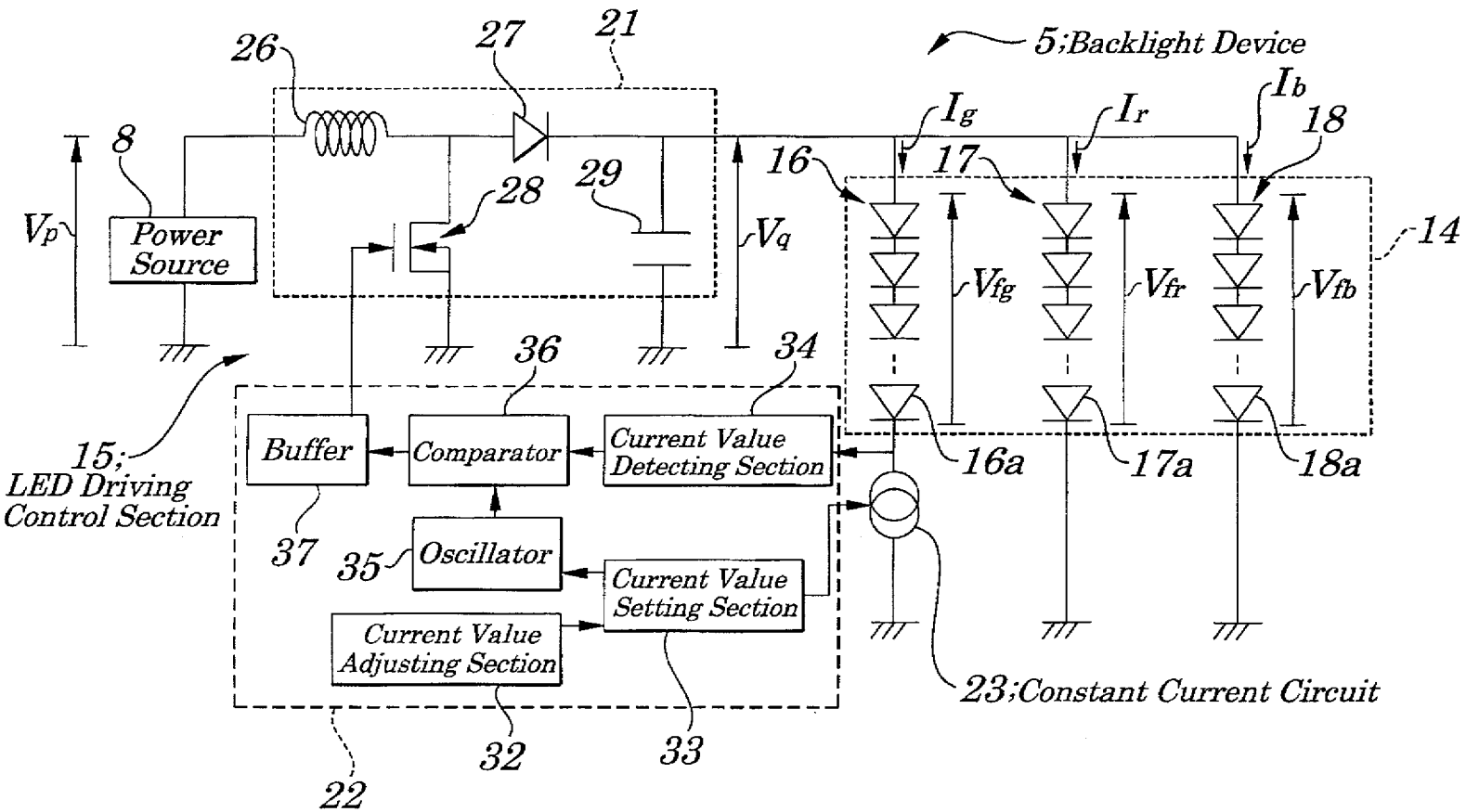
FIG. 1 is a schematic block diagram showing electrical configurations of a backlight device according to a first exemplary embodiment of the present invention.
Figure 2:
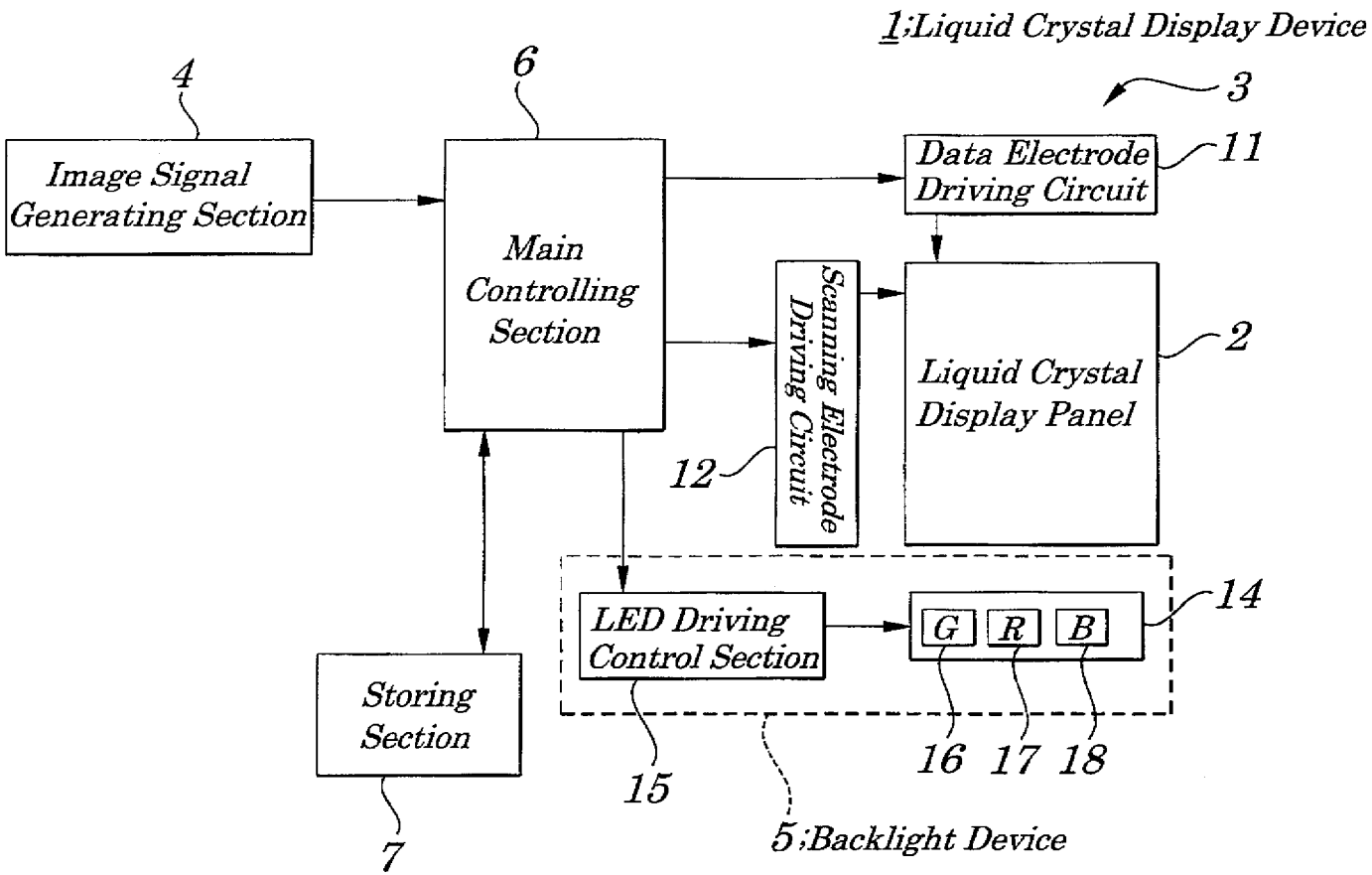
FIG. 2 is a block diagram showing a liquid crystal display device equipped with the backlight device of FIG. 1.
Figure 3:
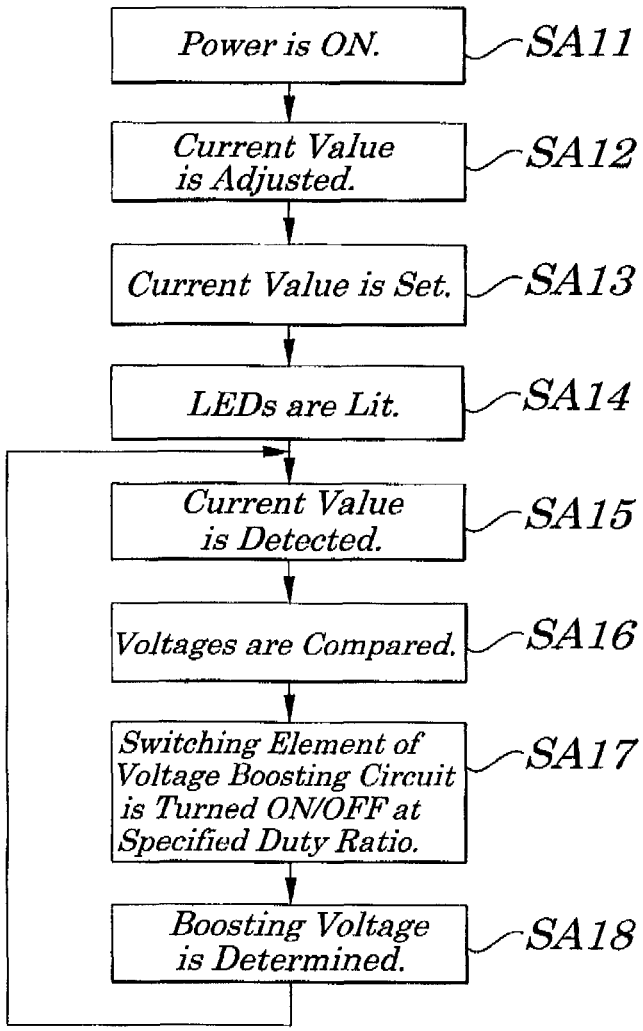
FIG. 3 is a diagram explaining operations of the backlight device of FIG. 1.
Figure 4:
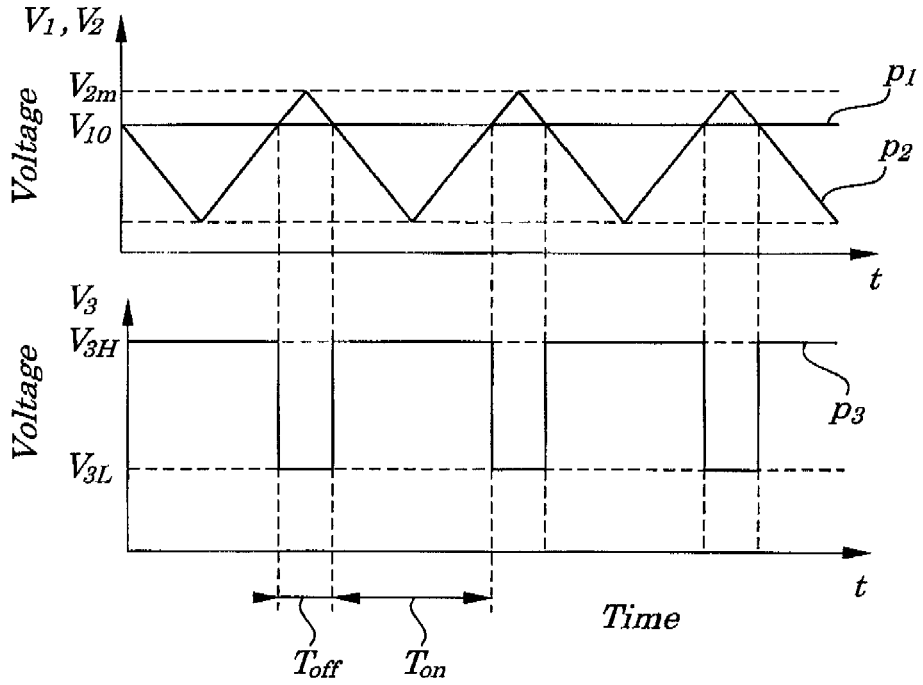
FIG. 4 is an explanatory diagram of operations of an LED driving control section of the backlight device of FIG. 1.

FIG. 1 is a schematic block diagram showing electrical configurations of a backlight of the first exemplary embodiment of the present invention. FIG. 2 is a block diagram showing a liquid crystal display device equipped with the backlight of FIG. 1. FIG. 3 is an explanatory diagram of operations of the backlight of FIG. 1, and FIG. 4 is an explanatory diagram of operations of an LED driving control section of the backlight of FIG. 1.

The liquid crystal display device 1, as shown in FIG. 2, includes a liquid crystal display panel 2, an LCD (Liquid Crystal Display) driving circuit section 3, an image signal generating section 4 to generate a corresponding image signal based on image data fed from the outside, a backlight device 5 to supply illuminating light to the liquid crystal display panel 2, a main controlling section 6 made up of, for example, a CPU (Central Processing Unit) to perform specified control functions and computation function, a storing section 7 made up of a ROM (Read Only Memory), RAM (Random Access Memory), or a like to store a processing program to be executed by the main controlling section 6 or various data or a like, and a power source 8 to supply a DC (Direct Current) to drive the backlight device 5.

The liquid crystal display panel 2 is a transmissive-type liquid crystal panel having, for example, a TFT (Thin Film Transistor) structure made up of a TFT substrate on which a large number of driving TFTs and transparent pixel electrodes are formed and a facing substrate fixed in a manner to face the TFT substrate with a clearance of several microns interposed and having a coloring layer (color filter), a liquid crystal layer sealed in the above clearance, and a pair of deflection plates placed outside of the TFT substrate and facing substrate. On the TFT substrate are formed a large number of transparent pixel electrodes in a matrix form and in a region surrounding each of the transparent pixel electrodes is formed each of scanning lines to feed a scanning signal and each of signal lines to feed a display signal in a manner to be orthogonal to one another.

A driving TFT is placed near to each intersection of each of the scanning lines and signal lines and serves as a switching element whose source electrode is connected to the transparent pixel electrodes to apply a signal electrode to a corresponding liquid crystal cell. Also, on the facing substrate, coloring layers of red, green, and blue colors are arranged, for example, in a mosaic form and facing electrodes are formed on the transparent insulating substrate and a facing electrode is formed in a manner to cover the coloring layer. Further, on the facing electrode is formed a liquid crystal orientation film in a manner to cover the facing electrode. Moreover, the LCD driving circuit section 3 has a data electrode driving circuit (source driver) 11 to feed a display signal (data signal) to each of the signal lines and a scanning electrode driving circuit (gate driver) 12 to feed a scanning line to each of the scanning lines.

The backlight device 5, as shown in FIGS. 1 and 2, is made up of a light source unit 14 having a plurality of LEDs arranged in a plane form, an LED driving control section 15 to drive and control each LED making up the light source unit 14, and an optical material group including a light guiding plate (not shown) to receive light emitted from the light source unit 14 and to emit flat illuminating light to the liquid crystal display panel 2, a diffusion sheet to compensate for variations in luminance, a prism sheet to gather illuminating light entered from a light guiding plate, wherein illuminating light is applied to the liquid crystal display panel 2 from a rear side and light passed through the liquid crystal display panel 2 is recognized visually by an observer.

The light source unit 14, as shown in FIG. 1, is made up of a green LED group 16 having a plurality of green LEDs 16*a*, 16*a*, . . . , being connected in series to one another, a red LED group 17 having a plurality of red LEDs 17*a*, 17*a*, . . . , being connected in series to one another, and a blue LED group 18 having a plurality of blue LEDs 18*a*, 18*a*, . . . , being connected in series to one another, each group being connected in parallel to a voltage boosting circuit 21. To a cathode side of the green LED group 16 is connected a constant current circuit 23. In this exemplary embodiment, in order to obtain white light having specified chromaticity, specified numbers of each of the green LEDs 16*a*, red LEDs 17*a*, and blue LEDs 18*a* are arranged.

The LED driving control section 15 is made up of the voltage boosting circuit 21 to boost a voltage of the power source 8 and to apply the boosted voltage to the green LED group 16, red LED group 17, blue LED group 18, a power source controlling section 22 to control currents to be fed to the green LED group 16, and the constant current circuit 23 connected in series to a cathode side of the green LED group 16.

In this exemplary embodiment, a required constant current Ig controlled by the power source controlling section 22 is supplied from the voltage boosting circuit 21 to the LED group, out of the green LED group 16, red LED group 17, and blue LED 18, having an appropriate highest forward voltage required to obtain a specified light emission intensity. That is, if a forward voltage Vfg of the green LED group 16 is highest out of the green LED voltage Vfg, red LED voltage Vfr, and blue LED voltage Vfb, the constant current Ig is fed to the green LED group 16. Further, the voltage boosting circuit 21 is connected in parallel to each of the green LED group 16, red LED group 17, and blue LED group 18. The constant current circuit 23 is connected only to the green LED group 16.

The voltage boosting circuit 21 of the exemplary embodiment is made up of a boost-type DC/DC converter circuit which has an inductor 26 connected to the power source 8, a diode 27, a switching element 28 made up of an FET connected in parallel to the power source 8 and inductor 26, and a capacitor 29 connected in parallel to the diode 27 and switching element 28.

The positive terminal of the power source 8 is connected through the inductor 26 to a drain of the switching element 28 and to an anode of the diode 27. Also, a cathode of the diode 27 is connected to the capacitor 29 and to an anode of the green LED 16*a* (red LED 17*a* and blue LED 18*a*) placed nearest to a positive terminal out of the green LEDs making up the green LED group 16 (red LED group 17 and blue LED 18). Moreover, a negative terminal of the power source 8 is connected to a source of the switching element 28, the capacitor 29, the constant current circuit 23, and a cathode of the red LED 17*a* (blue LED 18*a*) placed nearest to a negative terminal out of the red LEDs 17*a* making up the red LED group 17 (blue LED group 18).

The power source controlling section 22 includes a current value adjusting section 32 to determine a set value of a current to be supplied to the green LED group 16, a current value setting section 33 to control the constant current circuit 23 and an oscillator 35 based on a set current value, a current value detecting section 34 to detect a current being fed to the green LED group 16, the oscillator 35 to generate a triangular wave signal having a specified period and amplitude, a comparator 36 to compare a triangular wave signal inputted from the oscillator 35 with a detecting signal corresponding to a detected current value and to output a high-level signal when the current value of the detecting signal is larger than that of the triangular wave signal and to output a low-level signal when the current value of the detecting signal is smaller than that of the triangular wave signal, and a buffer 37 to amplify an output from the comparator 36 and to apply the output to a gate of the switching element 28.

The current value setting section 33 receives a current value setting signal and controls the constant current circuit 23 and the oscillator 35. The current value detecting section 34 detects a current being supplied to the green LED group 16 and outputs a detecting signal p1 (V1=V10) according to the detected current (see FIG. 4). The oscillator 35 generates a triangular wave signal p2 having a specified period and amplitude (V2=V2*m*) corresponding to a set current value according to control from the current value setting section 33.

The comparator 36 compares the triangular wave signal p2 inputted from the oscillator 35 with the detecting signal p1 corresponding to the detected current value and outputs a rectangular wave signal p3 which becomes high (V3=V3H) when the current value of the detecting signal p1 is larger than that of the triangular wave signal and becomes low (V3=V3L) when the current value of the detecting signal p1 is smaller than that of the rectangular wave. Here, a ratio of a high-level period to a period becomes a duty ratio D (D=Ton/Ton+Toff). The buffer 37 amplifies an output from the comparator 36 and applies the amplified output to a gate of the switching element 28.

Next, by referring to FIGS. 3 and 4, operations of the backlight device 5 of the liquid crystal display device 1 of the exemplary embodiment will be explained. As shown in FIGS. 1 and 3, after power is ON (Step SA11), the current value adjusting section 32 of the power source controlling section 22 adjusts a current value to set luminance and chromaticity (Step SA12) and the current value adjusting section 32 transmits a current value setting signal to the current value setting section 33 (Step SA13). The current value setting section 33, when receiving the current value setting signal from the current value adjusting section 32, controls the constant current circuit 23 and the oscillator 35.

In an initial state, the switching element 28 is in an OFF state and an output voltage Vq of the voltage boosting circuit 21 is applied to the green LED group 16 being serially connected and to the constant current circuit 23 and also to the red LED group 17 and blue LED group 18, which causes the green LEDs 16*a*, 16*a*, . . . , red LEDs 17*a*, 17*a*, . . . , and blue LEDs 18*a*, 18*a*, . . . to be lit (Step SA14).

That is, the comparator 36 compares a triangular wave signal inputted from the oscillator 35 with a detecting signal corresponding to the detected current value (in an initial state, Ig=0) and, for example, a high level signal is outputted when the current value of the detecting signal is larger than that of the triangular wave signal and a low-level signal is outputted when the current value of the detecting signal is smaller than that of the triangular wave signal. In the initial state, D=0, which causes the switching element 28 to be in an OFF state.

The current value setting section 33, when receiving a current value setting signal from the current value adjusting section 32, controls not only the oscillator 35 but also the constant current circuit 23 so that a current fed to the green LED group 16 becomes a constant current. The current value detecting section 34 detects a current being fed to the green LED group 16 and outputs a detecting signal p1 corresponding to the current (Step SA15). The oscillator 35 generates a triangular wave signal p2 having a specified period and amplitude (V2=V2*n*) corresponding to the current value according to control from the current value setting section 33.

The comparator 36, as shown in FIG. 4, compares a triangular wave signal p2 inputted from the oscillator 35 with the detecting signal p1 corresponding to the detected current value and outputs a rectangular wave signal p3 which becomes high (V3 =V3H) when the current value of the detecting signal p1 is larger than that of the triangular wave signal p2 and becomes low (V3=V3L) when the current value of the detecting signal p1 is smaller than that of the triangular wave signal p2 (Step SA16). Here, a ratio of a high-level period to a period becomes a duty ratio D (D=Ton/Ton+Toff) (Step SA17). The buffer 37 amplifies an output from the comparator 36 and applies the amplified output to a gate of the switching element 28.

Thus, the switching element 28 is turned ON/OFF by the voltage boosting circuit 21 at a specified duty ratio D and the output voltage Vq of the boosting circuit 21 is boosted relative to the power voltage Vp and Vq=Vp(1/(1−D)) (Step SA18).

The output voltage Vq is applied to the green LED group 16 serially connected and the constant current circuit 23, which causes a current Ig to flow through the green LED group 16, and the output voltage vq is also applied to the red LED 17 and the blue LED group 18, which also causes a current Ir to flow through the red LED group 18 and a current Ib to flow through the blue LED group 18 and, as a result, the green LEDs 16*a*, 16*a*, . . . , red LEDs 17*a*, 17*a*, . . . , and blue LEDs 18*a*, 18*a*, . . . , are turned ON, thus providing illuminating light having specified light emission intensity and chromaticity.

When the output voltage Vq is large and a current being supplied to the green LED group 16 is larger than a set value, as shown in FIG. 4, since the duty ratio D becomes large, control is exerted so that the output voltage Vq becomes small and when the output voltage Vq is small and a current being supplied to the green LED group 16 is smaller than a set value, the duty ratio D becomes small, control is exerted so that the output voltage Vq becomes small. Incidentally, by storing the current value having been once set in the storing section 7, the adjustment of the current value at every time of power supply is not required.

Thus, according to the configurations described above, by supplying a required constant current from the voltage boosting circuit 21 to the green LED group 16 having the most suitable and highest forward voltage required to obtain specified light emission, out of the green LED group 16, red LED group 17, and blue LED group 18 and by connecting the green LED group 16 to the voltage boosting circuit 21 and by connecting the red LED group 17 and blue LED group 18 in parallel to the constant current circuit 23, not only the green LED group 16 but also the red LED group 17 and blue LED 18, each having specified emission intensity, can be obtained.

That is, since a certainly required current is fed, in order to obtain specified amounts of light, to the green LED group 16 having the highest forward voltage, a desired light emission intensity, as a whole, can be obtained.

Incidentally, one set of the constant current circuit 23 and one set of the power controlling section 22 are sufficient as a circuit to feed a constant current to the green LED group 16 and, therefore, the simplification of circuit configurations, the reduction of costs and of consumed currents can be achieved. For example, no constant current circuit is connected to the red LED group 17 and blue LED group 18, thus enabling the avoidance of wasteful consumption of power. Moreover, by setting, in advance, the number of the green LEDs 16*a*, red LEDs 17*a*, and blue LEDs 18*a* respectively making up the green LED group 16, red LED group 17 and blue LED group, colored light having desired chromaticity (for example, white color) can be obtained.

Second Exemplary Embodiment

Figure 5:
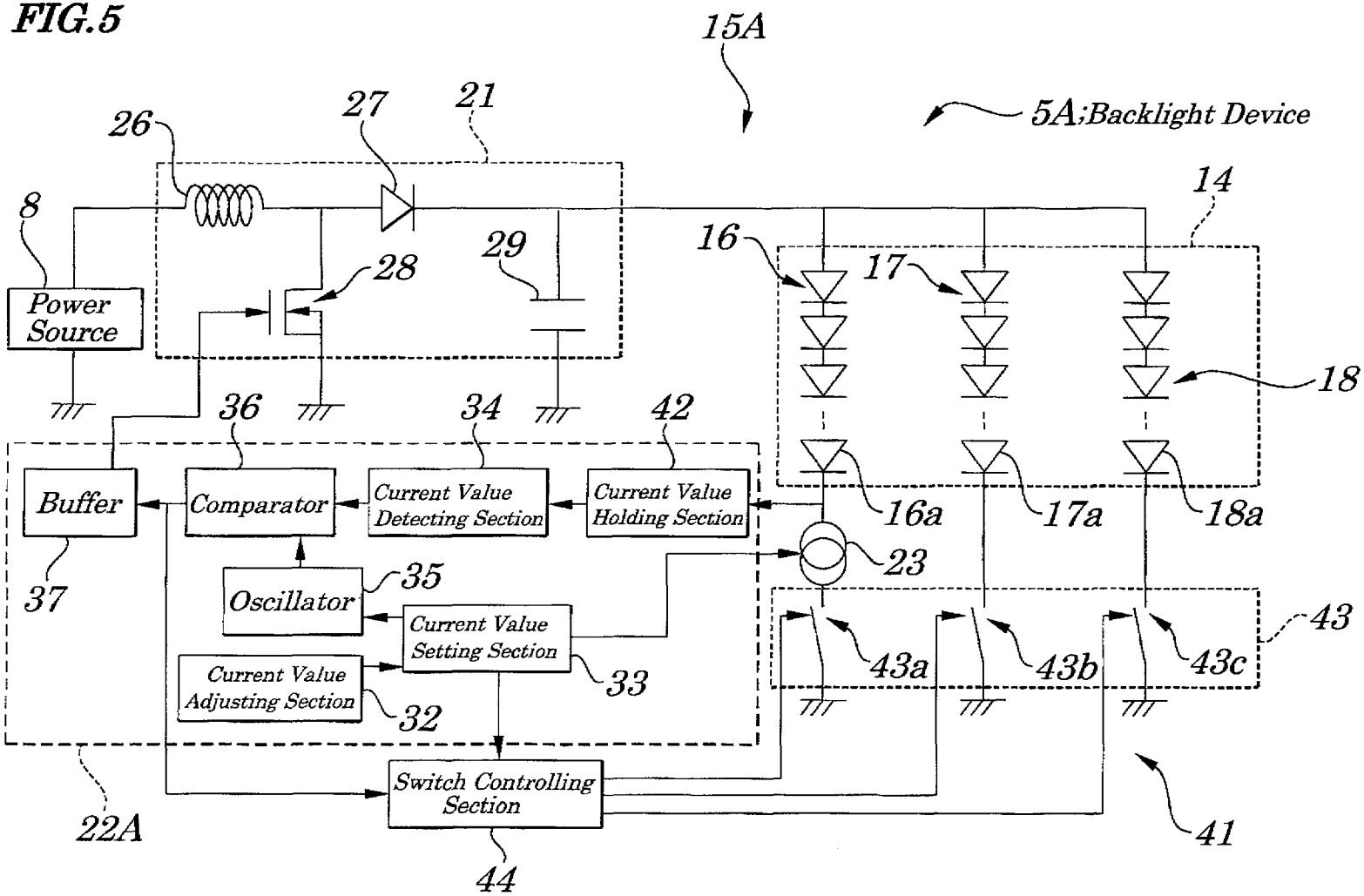
FIG. 5 is a schematic block diagram showing electrical configurations of a backlight device according to a second exemplary embodiment of the present invention.
Figure 6:
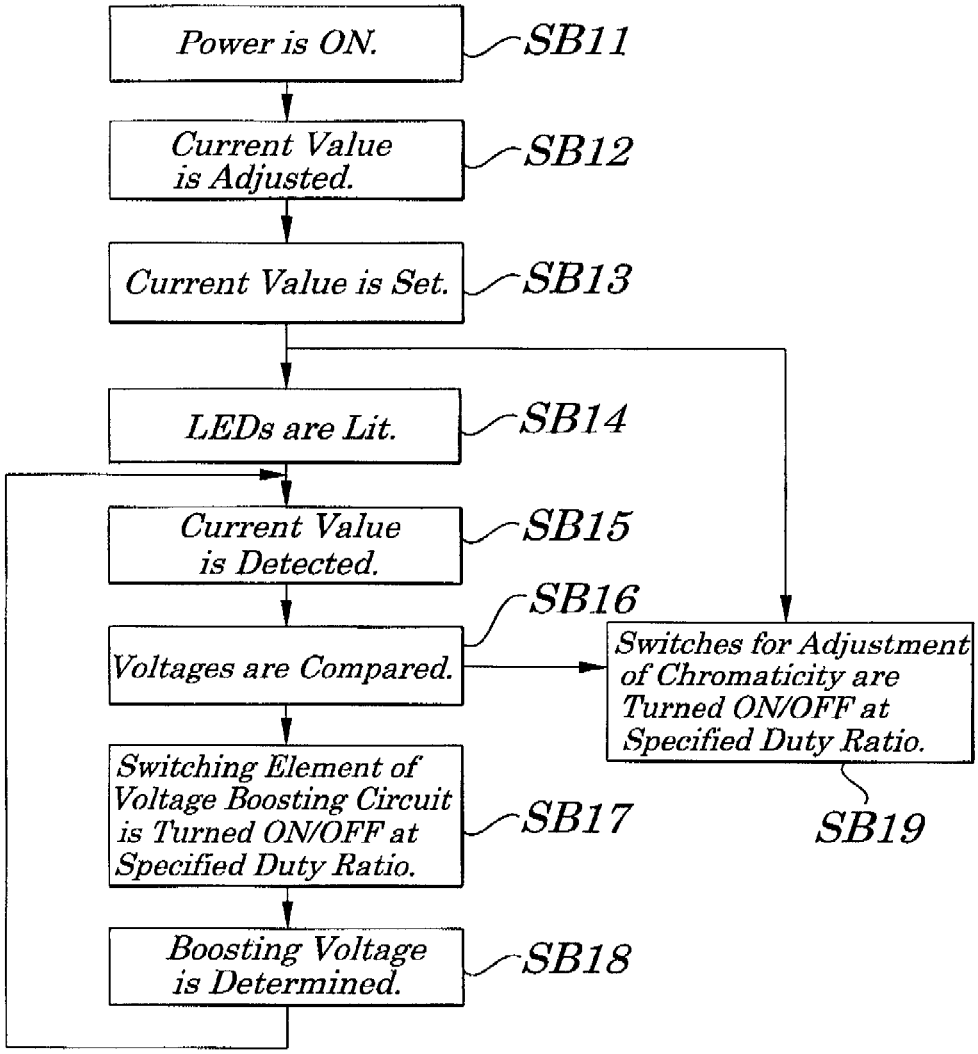
FIG. 6 is a diagram showing operations of the backlight device of FIG. 5.

FIG. 5 is a schematic block diagram showing electrical configurations of a backlight device according to the second exemplary embodiment. FIG. 6 is a diagram showing operations of the backlight device of FIG. 5. The configurations of the second exemplary embodiment differ greatly from those of the first exemplary embodiment in that currents flowing through each LED group are switched so that chromaticity can be adjusted. The configurations other than the above are almost the same as those of the first exemplary embodiment and, therefore, in FIG. 5, the same reference numbers are assigned to the same configurations as those in FIG. 1 and their descriptions are simplified accordingly.

The backlight device 5A of the liquid crystal display device of the second exemplary embodiment, as shown in FIG. 5, has a light source unit 14, an LED driving control section 15A to drive and control each of the LEDs making up the light source unit 14 and an optical member group. The light source unit 14 has a green LED group 16, red LED group 17, and blue LED group 18, each being connected to a voltage boosting circuit 21. Here, to a cathode side of the green LED group 16 is connected a constant current circuit 23 and to a negative terminal side of the constant current circuit 23 is connected a switch 43*a* for chromaticity adjustment. Also, to cathode sides of the red LED group 17 and blue LED group 18 are respectively connected a switch 43*b* and a switch 43*c* for chromaticity adjustment.

The LED driving control section 15A has the voltage boosting circuit 21, a power source controlling section 22A to control a current to be supplied to the green LED group 16, the constant current circuit 23, and a chromaticity adjusting section 41. The voltage boosting circuit 21 has an inductor 26 connected to a power source 8, a diode 27, a switching element 28, and a capacitor 29. The power source controlling section 22A includes a current value adjusting section 32, a current value setting section 33, a current value holding section 42 made up of, for example, a sample/hold circuit which enables detection of a current while switching control is exerted, a current value detecting section 34, an oscillator 35, a comparator 36, and a buffer 37.

The chromaticity adjusting section 41 includes a chromaticity adjusting switch section 43 made up of switches 43*a*, 43*b*, and 43*c* using, for example, an FET and a switch controlling section 44 to turn ON/OFF the switches 43*a*, 43*b*, and 43*c* (to turn ON/OFF the green LED group 16, red LED group 17, and blue LED group 18) at each specified duty ratio to obtain color having a specified chromaticity. Incidentally, a frequency of the switches 43*a*, 43*b*, and 43*c* for an ON/OFF operation is set to be about 80 [Hz] or more to prevent the occurrence of flicker.

Next, operations of the backlight device 5A of the exemplary embodiment are explained by referring to FIGS. 5 and 6. As shown in FIGS. 5 and 6, after the power is ON (Step SB11), the current value adjusting section 32 of the power source controlling section 22A adjusts a current value of luminance and chromaticity (Step SB12) and the current value setting section 33 transmits a current value setting signal to the current value setting section 33 (Step SB13). The current value setting section 33, when having received the current value setting signal from the current value adjusting section 32, controls the constant current circuit 23, oscillator 35, and switch controlling section 44.

In an initial state, the switching element 28 is in an OFF state and the switches 43*a*, 43*b*, and 43*c* are in an ON state and an output voltage Vq is applied to the green LED group 16 connected in series and to the constant current circuit 23 and also to the red LED group 17, the blue LED group 18, which causes the green LEDs 16*a*, 16*a*, . . . , red LEDs 17*a*, 17*a*, . . . , and blue LEDs 18*a*, 18*a*, . . . , to be turned ON (Step SB14).

That is, the comparator 36 compares a triangular wave signal inputted from the oscillator 35 with a detected signal corresponding to a detected current value (at the initial time, Ig=0) and, for example, when the detected signal is large, a high-level signal is outputted and, when the detected signal is small, a low-level signal is outputted. In the initial state, when D=0, the switching element 28 is turned OFF.

The current value setting section 33 is configured to receive a current value setting signal from the current value adjusting section 32 and controls not only the oscillator 35 but also the constant current circuit 23 and exercises control so that the current to be fed to the green LED group 16 is made to become a set constant current. The current value detecting section 34 detects a current being fed to the green LED group 16 and outputs a detecting signal p1 corresponding to the current (Step SB15). The oscillator 35 generates a triangular wave signal p2 having a specified period and amplitude corresponding to the set current value according to control from the current value setting section 33.

The comparator 36 compares a triangular wave signal inputted from the oscillator 35 with a detected signal p1 corresponding to a detected current value (at the initial time, Ig=0) and, for example, a rectangular wave signal p3 is outputted which becomes a high-level signal when the detected signal p1 is large and which becomes a low-level signal when the detected signal p1 is small (Step SB16). Incidentally, a ratio of a high-level period to a period becomes a duty ratio D (Step SB17). The buffer 37 amplifies an output from the comparator 36 and applies the amplified output to a gate of the switching element 28. Moreover, the switch controlling section 44 receives a current value setting signal from the current value setting section 33 and the rectangular wave signal p3 from the comparator 36 and turns ON/OFF the switches 43*a*, 43*b*, and 43*c* at each specified duty ratio to adjust so as to obtain specified chromaticity (Step SB19).

In the voltage boosting circuit 21, the switching element 28 is turned ON/OFF at a specified duty ratio D (Step SB18). The output voltage Vq is applied to the green LED group 16 and constant current circuit 23 and also to the red LED group 17 and blue LED group 18, which causes the green LEDs 16*a*, 16*a*, . . . , red LEDs 17*a*, 17*a*, . . . , and green LEDs 18*a*, 18*a*, . . . , to be turned ON and, as a result, illuminating light having a specified amount of light and chromaticity can be obtained.

Thus, according to the configurations of the second exemplary embodiment, approximately the same effect as in the first exemplary embodiment described above can be obtained. Additionally, the switch controlling section 44 turns ON/OFF the switches 43*a*, 43*b*, and 43*c* at each specified duty ratio and, therefore, an amount of the green LED group 16, red LED group 17, and blue LED group 18 is individually controlled, which is serially connected in the same order respectively to the switch 43*a*, 43*b*, and 43*c*, and, as a result, chromaticity and the amount of illuminating light can be freely (in a wide range) adjusted as a whole.

Third Exemplary Embodiment

Figure 7:
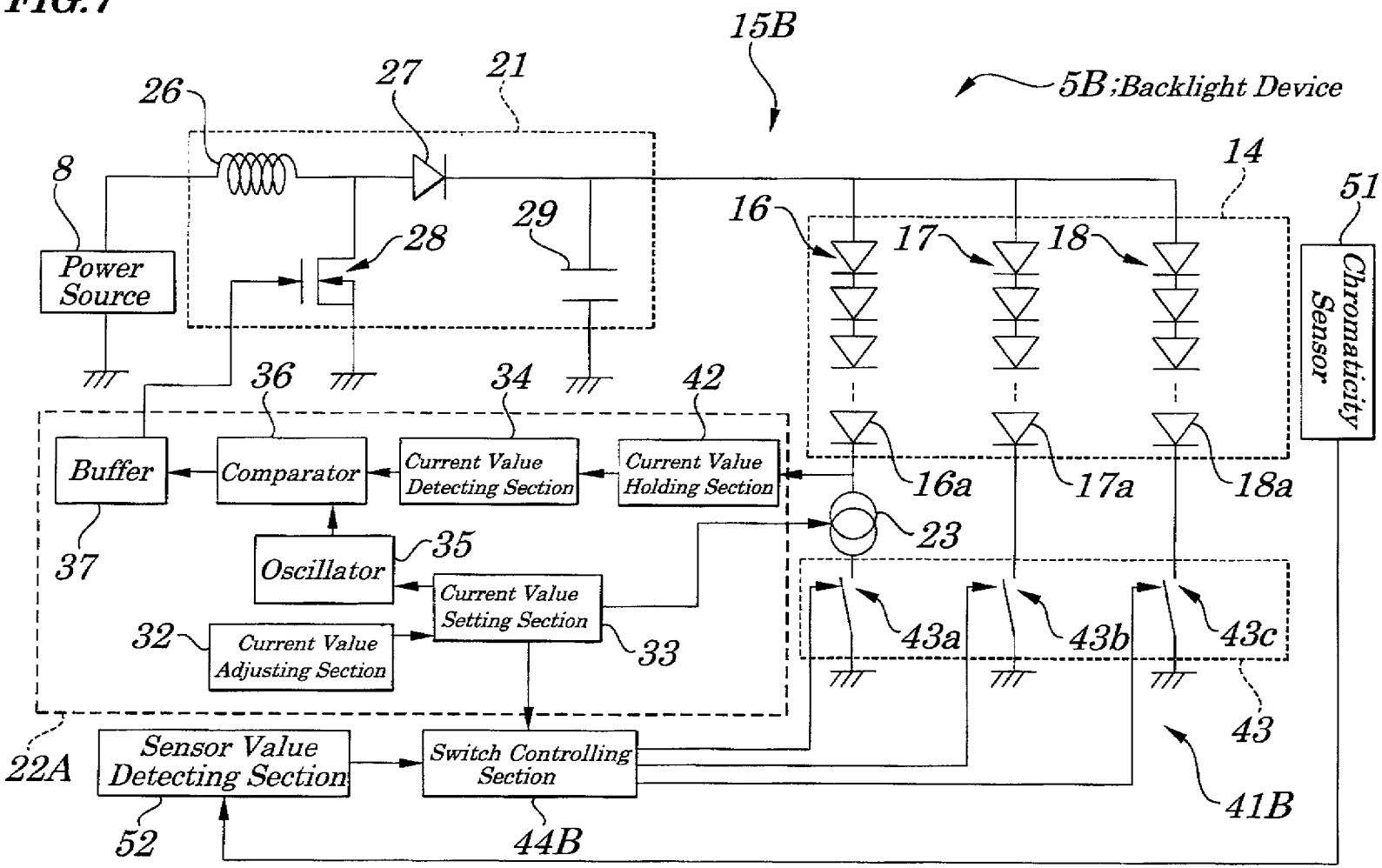
FIG. 7 is a schematic block diagram showing electrical configurations of a backlight device according to a third exemplary embodiment of the present invention.

FIG. 7 is a schematic block diagram showing electrical configurations of a backlight device according to the third exemplary embodiment of the present invention. The configurations of the third exemplary embodiment differ greatly from those of the second exemplary embodiment in that a chromaticity sensor is newly provided and the backlight device is so configured as to control a current flowing through each LED. The configurations other than the above are almost the same as those of the second exemplary embodiment and, therefore, in FIG. 7, the same reference numbers are assigned to the same configurations as those in FIG. 5 and their descriptions are simplified accordingly.

The backlight device 5B of the liquid crystal display device of the third exemplary embodiment, as shown in FIG. 7, includes a light source unit 14, LED driving control section 15B to drive and control each LED making up the light source unit 14, and an optical member group. The LED driving control section 15B has a voltage boosting circuit 21, a power source controlling section 22A, a constant current circuit 23, and chromaticity adjusting section 41B.

The chromaticity adjusting section 41B includes a chromaticity adjusting switch 43, the chromaticity sensor 51 to detect chromaticity of colored light emitted from the light source unit 14, a sensor value detecting section 52, and a switch controlling section 44B to turn ON/OFF switches 43*a*, 43*b*, and 43*c* at each specified duty ratio based on detected chromaticity to hold specified chromaticity.

Thus, according to the configurations of the third exemplary embodiment, approximately the same effect as in the second exemplary embodiment described above can be obtained. Additionally, by suppressing the variations of chromaticity, desired chromaticity can be held.

Fourth Exemplary Embodiment

Figure 8:
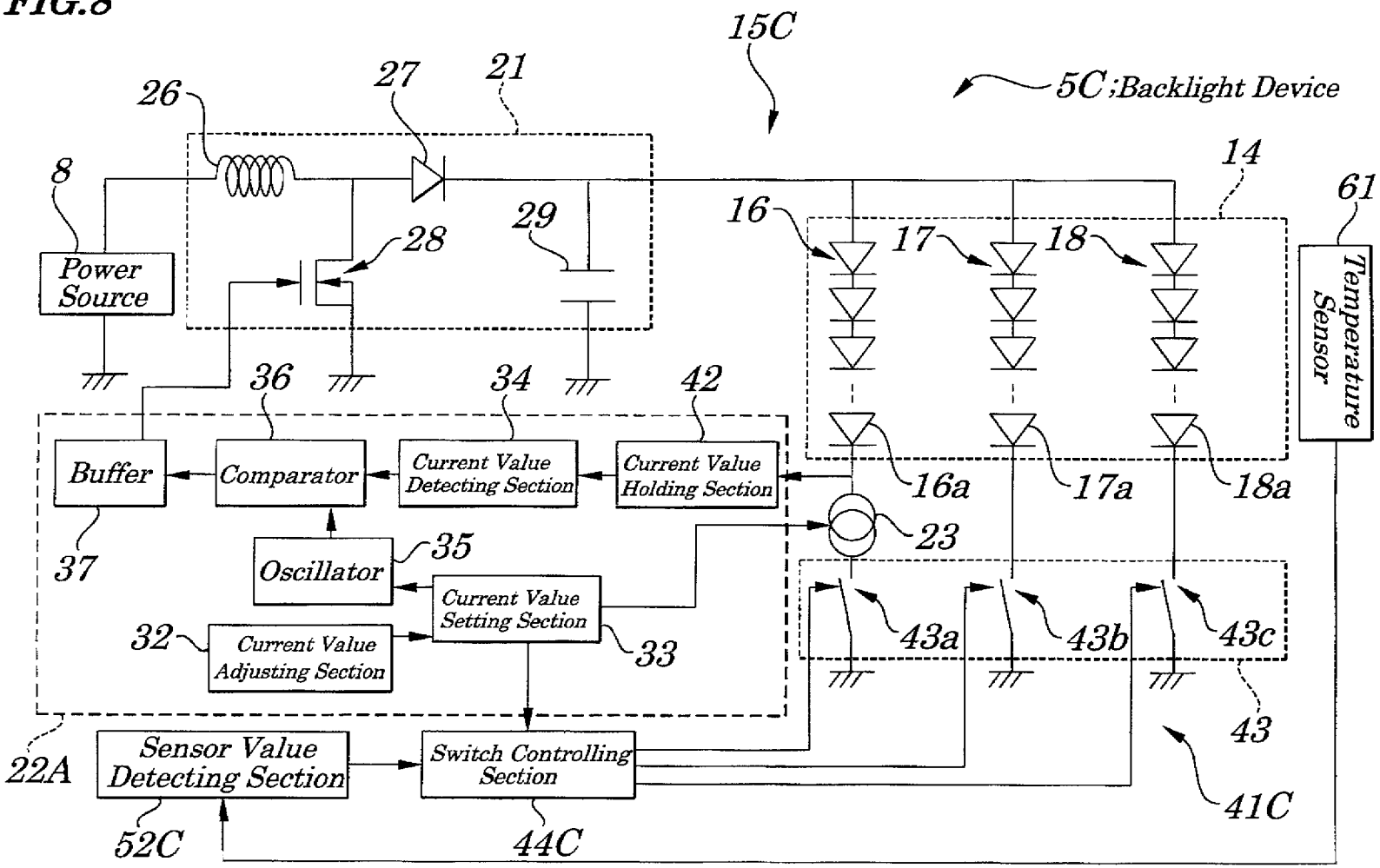
FIG. 8 is a schematic block diagram showing electrical configurations of a backlight device according to a fourth exemplary embodiment of the present invention.

FIG. 8 is a schematic block diagram showing electrical configurations of a backlight device of the fourth exemplary embodiment of the present invention. The configurations of the fourth exemplary embodiment differ greatly from those of the third exemplary embodiment in that a temperature sensor is newly provided and the backlight device is so configured as to control a current flowing through each LED. The configurations other than the above are almost the same as those of the third exemplary embodiment and, therefore, in FIG. 8, the same reference numbers are assigned to the same configurations as those in FIG. 5 and their descriptions are simplified accordingly.

The backlight device 5C of the liquid crystal display device of the fourth exemplary embodiment, as shown in FIG. 8, includes a light source unit 14, an LED driving control section 15C to drive and control each LED making up the light source unit 14, and an optical member group. The LED driving control section 15C has a voltage boosting circuit 21, a power source controlling section 22A, a constant current circuit 23, and chromaticity adjusting section 41C.

The chromaticity adjusting section 41C has a chromaticity adjusting switch section 43, the temperature sensor 61 to detect an ambient temperature around the light source unit 14, a sensor value detecting section 52C, and a switch controlling section 44C to turn ON/OFF switches 43*a*, 43*b*, and 43*c* based on detected temperature at each specified duty ratio to maintain the chromaticity.

Thus, according to the configurations of the fourth exemplary embodiment, approximately the same effect as in the second embodiment described above can be obtained. Additionally, variations of chromaticity of illuminating light due to temperatures can be suppressed.

Fifth Exemplary Embodiment

Figure 9:
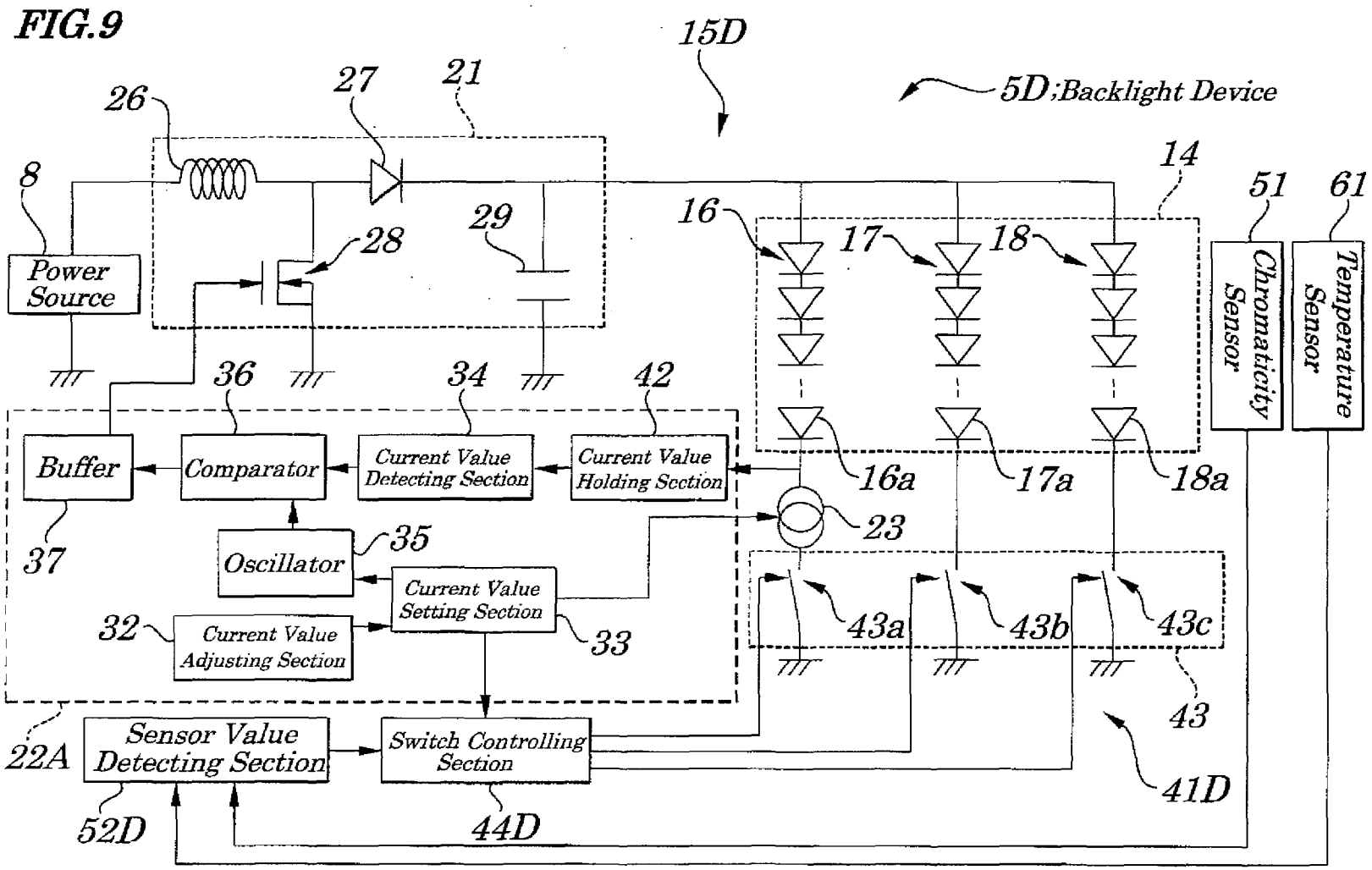
FIG. 9 is a schematic block diagram showing electrical configurations of a backlight device according to a fifth exemplary embodiment of the present invention.
Figure 10:
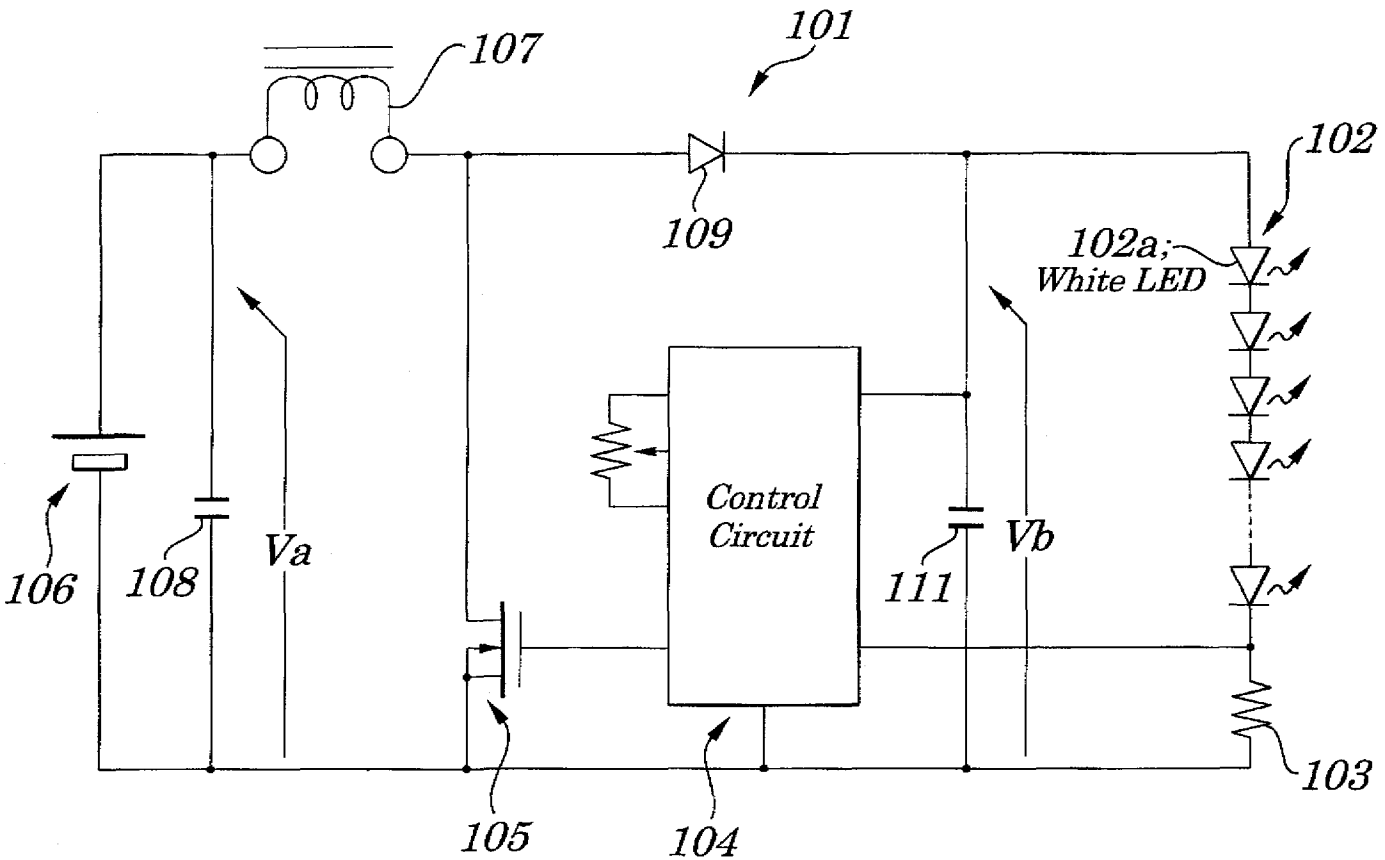
FIG.10 (RELATED ART)
FIG. 10 is a schematic block diagram showing electrical configurations of a related technology.
Figure 11:
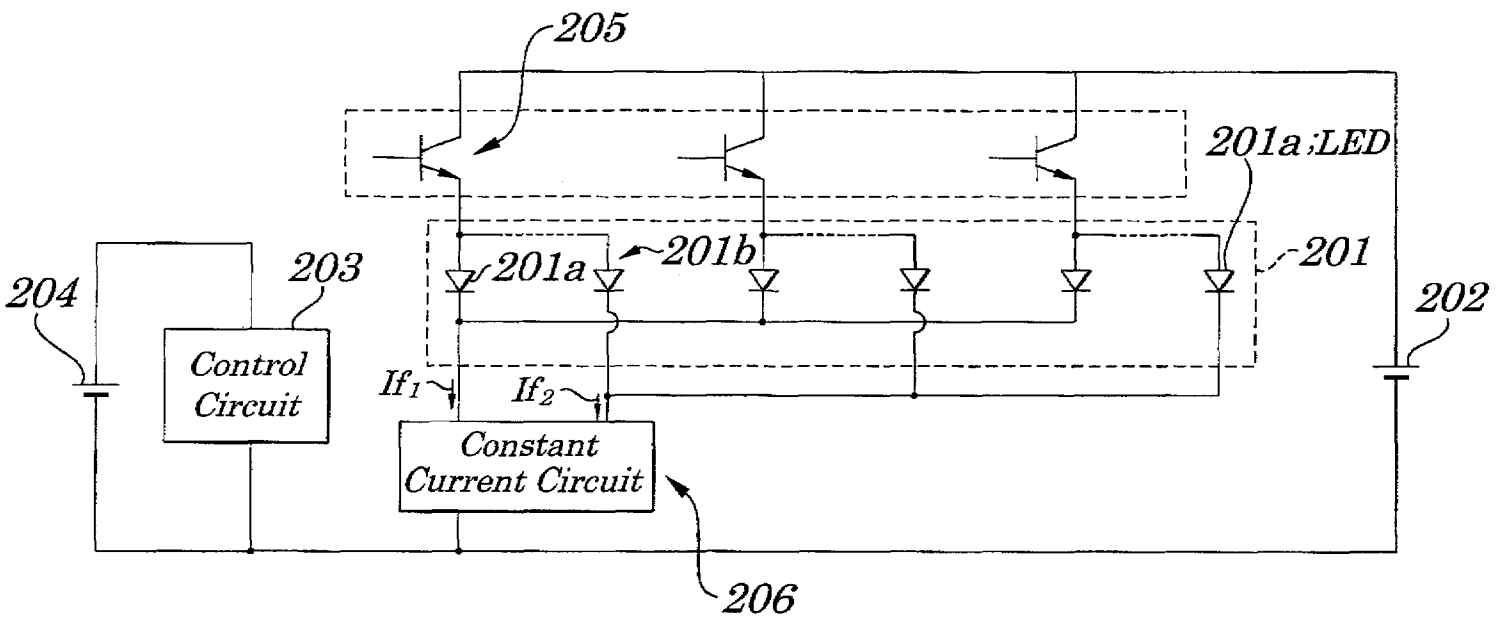
FIG.11 (RELATED ART)
FIG. 11 is a schematic block diagram showing electrical configurations of another related technology.
Figure 12:
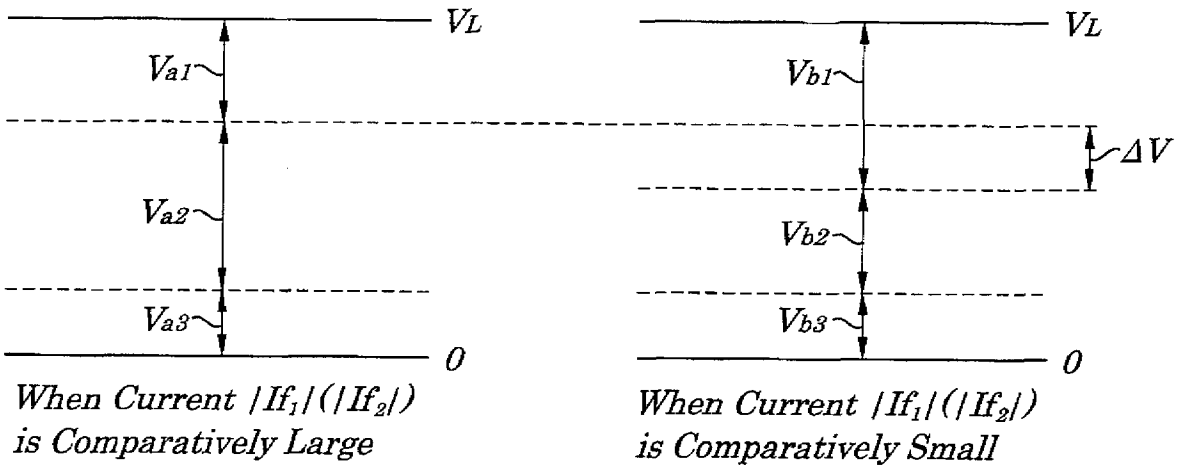
FIG. 12 (RELATED ART)
FIG. 12 is an explanatory diagram explaining the other related technology.

FIG. 9 is a schematic block diagram showing electrical configurations of a backlight device according to the fifth exemplary embodiment of the present invention. The configurations of the fifth exemplary embodiment differ greatly from those of the fourth exemplary embodiment in that a chromaticity sensor in addition to a temperature sensor is newly provided and the backlight device is so configured as to control a current flowing through each LED. The configurations other than the above are almost the same as those of the third exemplary embodiment and, therefore, in FIG. 9, the same reference numbers are assigned to the same configurations as those in FIG. 7 and their descriptions are simplified accordingly.

The backlight device 5D of the liquid crystal display device of the fifth exemplary embodiment, as shown in FIG. 9, includes a light source unit 14, an LED driving control section 15D to drive and control each LED making up the light source unit 14, and an optical member group. The LED driving control section 15D has a voltage boosting circuit 21, a power source controlling section 22A, a constant current circuit 23, and chromaticity adjusting section 41D.

The chromaticity adjusting section 41D has a chromaticity adjusting switch section 43, a chromaticity sensor 51 to detect a chromaticity of colored light emitted from the light source unit 14, a temperature sensor 61 to detect a temperature in portions surrounding the light source unit 14, a sensor value detecting section 52D, and a switch controlling section 44D to turn ON/OFF switches 43*a*, 43*b*, and 43*c* based on detected temperature at each specified duty ratio to maintain the chromaticity.

Thus, according to the configurations of the fifth exemplary embodiment, approximately the same effect as in the third exemplary embodiment described above can be obtained. Additionally, desired chromaticity can be maintained and variations of chromaticity due to temperatures can be suppressed.

While the invention has been particularly shown and described with reference to exemplary embodiments thereof, the invention is not limited to theses embodiments. It will be understood by those of ordinary skill in the art that various changes in form and details may be made therein without departing from the sprit and scope of the present invention as defined by the claims. For example, in the above exemplary embodiment, the case where the constant current circuit is connected only to the green LED group is described, however, the constant current circuit may be connected also to any of the red LED group and blue LED group. Also, a plurality of green LED groups, a plurality of red LED groups and a plurality of blue LED groups may be placed. Moreover, not only the LED of the same kind (same color) but also the LED of a different kind may exist in a mixed manner.

Incidentally, for example, the current value setting processing, current value adjusting processing, or a like can be performed by letting the power supply controlling section having the CPU execute a corresponding control program and part or whole of the current value setting processing, current value adjusting processing, or the like may be performed partially or totally by using hardware and by using a corresponding program. Additionally, the current value setting processing, current value adjusting processing, or the like may be performed by using separate CPUs or by using a single CPU.

The color of light emitted from the LED may be not only red, green, and blue but also orange, yellow, and yellowish green. Also, a white LED can be additionally employed. The white colored light to be emitted may be prepared by combining a UV (Ultraviolet) LED with red, green, blue fluorescent bodies, by combining a blue LED with red and green fluorescent bodies, or by combining a blue LED with a yellow fluorescent body. Not only three kinds of LEDs (three colors) but also four kinds of LEDs may be used, or two kinds of LEDs may be employed.

Incidentally, LEDs emitting colored light having complementary colors of red, green, and blue (respectively, cyan, magenta, and yellow) may be employed as the first, second, and third complementary light emitting devices. Here, the LED emitting colored light having a complementary color of red may be configured by the blue LED and a fluorescent plate into which a fluorescent material emitting green light has been mixed and may be also configured by combining the white LED with a filter.

As the voltage boosting type DC/DC converter, in addition to a chopper circuit, a flyback converter circuit, forward converter circuit, push-pull converter circuit, half-bridge converter circuit, or the like may be used. Also, the power source circuit may be not only the voltage boosting circuit but also a voltage step-down circuit.

Also, the present invention can be applied, in addition to a backlight of the liquid crystal display device, for example, to an LED to be used for key illumination, flash illumination or a like. The present invention may be employed in a liquid crystal display panel in a normally white mode or in a normally black mode. The present invention may be applied to any scanning method including sequential scanning or interlace scanning.

Moreover, the current value adjusting section may be configured so that an operating section used to determine a current to be fed to the green LED group to determine a current value corresponding to a desired light emission intensity or so that the current value adjusting section is provided so as to receive a setting operation signal to adjust luminance or chromaticity from a main controlling section. The current value adjusting section may be configured so as to receive the above setting operation signal from a PC or a like connected to the liquid crystal display device. Moreover, the current value adjusting section may be configured so as to confirm light emission intensity or chromaticity and to determine a set value of an operating current in a state in which a current is being fed to the LED group.

Also, the constant current circuit may be located not only on the cathode side of the green LED group but also on its anode side. Moreover, the green LED, red LED and blue LED may be located not only in a plane-form but also in a line-form along the edge of a display panel.

Moreover, in the second exemplary embodiment, the switching control may be exercised independently without being based on a signal from the LED driving control section (current value setting section or comparator). Here, the switching control maybe exerted by changing a duty ratio for ON/OFF operation or by changing a period.

Incidentally, in the second exemplary embodiment, as a switch for chromaticity adjustment, an FET or a transistor may be employed.

Additionally, in the third exemplary embodiment, by providing the current value adjusting section with an operating section used to determine a current to be fed to the green LED group and by displaying chromaticity detected by a chromaticity sensor, in a state where a current is being fed to the LED group, light emission intensity or displayed chromaticity may be checked to determine a set value of a driving current.

The present invention may be also applied not only to a liquid crystal display device employing an active driving method using a TFT (Thin Film Transistor) but also to a liquid crystal display device employing a passive driving method. Moreover, driving control of a light emitting device can be employed not only to a light emission device such as an LED but also to other light emitting device such as an organic EL (Electro Luminescence) or a like.

With the above exemplary configurations of the present invention, the constant current circuit is serially connected to the specified light emitting device group out of the plurality of light emitting device groups, power is supplied by the power source circuit to each light emitting group, a current flowing through a specified light emitting device group is detected by the current detecting unit and the power source circuit is controlled by the power control unit based on a preset current value and a detected current value. Therefore, the power source circuit can be simplified, thus enabling reduction in costs and power consumption.

What is claimed is:

1. A light emission control circuit for driving and controlling a light source having a plurality of light emitting device groups for emitting a plurality of colored lights, connected in parallel to one another, each group comprising a plurality of light emitting devices for emitting a same colored light and being connected only serially to one another, said light emission control circuit comprising:

a constant current circuit connected serially to only a specified light emitting device group having a highest whole forward voltage required to obtain a specified light emission intensity, out of said plurality of light emitting device groups;

a power source circuit to apply its output voltage to said specified light emitting device group and said constant current circuit connected serially to one another, and other said light emitting device groups;

a current detecting unit to detect only a current to be supplied to said specified light emitting device group out of said plurality of light emitting device groups;

a power source controlling unit to control said constant current circuit and said power source circuit based on a current detected by said current detecting unit and a current set in advance so that said forward voltage is applied to said specified light emitting device group; and a chromaticity adjusting unit to adjust chromaticity of illuminating light emitted from said light source, wherein said power source controlling unit comprises:

an oscillator to generate a triangular wave signal having a specified period and amplitude, a comparator to compare said triangular wave signal inputted from said oscillator with a detecting signal corresponding to a current detected by said current detecting unit and to output a high-level or low-level signal according to magnitude of said triangular wave signal and said detecting signal, thereby controlling said power source circuit, a current value adjusting section to determine a set value of a current to be supplied to said specified light emitting device group, and a current value setting section to control said constant current circuit and said oscillator based on said set value of a current.

2. The light emission control circuit according to claim 1, wherein said plurality of said light emitting device group comprises a green light emitting device group emitting colored light of green, a red light emitting device group emitting colored light of red, and a blue light emitting device group emitting colored light of blue.

3. The light emission control circuit according to claim 1, wherein said chromaticity adjusting unit is connected serially to each of said light emitting device groups and comprises switching units to turn ON/OFF said power source circuit and a switch controlling unit to turn ON/OFF each of said switching units at a predetermined duty ratio to obtain specified chromaticity.

4. The light emission control circuit according to claim 3, wherein said chromaticity adjusting unit comprises a chromaticity detecting unit to detect chromaticity of colored light emitted from said light source and wherein said switch controlling unit controls said switching units based on chromaticity.

5. The light emission control circuit according to claim 3, wherein said chromaticity adjusting unit comprises a temperature detecting unit to detect a temperature of said light source or portions surrounding said light source and wherein said switch controlling unit controls each of said switching units based on said temperature.

6. The light emission control circuit according to claim 1, wherein said power source circuit comprises a boosting-type DC/DC (Direct Current/Direct Current) converter circuit having a switching element and wherein said power source controlling unit turns ON/OFF said switching element at a specified duty ratio to let said power source circuit apply said output voltage to each of said light emitting device groups.

7. The light emission control circuit according to claim 1, wherein said plurality of light emitting devices each comprises a light-emitting diode.

8. A light emission control method for driving and controlling a light source having a plurality of light emitting device groups for emitting a plurality of colored lights, connected in parallel to one another, each group comprising a plurality of light emitting devices for emitting a same colored light and being connected only serially to one another, wherein a constant current circuit is connected serially to only a specified light emitting device group having a highest whole forward voltage required to obtain a specified light emission intensity, out of said plurality of light emitting device groups; said light emission control method comprising:

a power supplying step in which a power source circuit applies its output voltage to said specified light emitting device group and said constant current circuit connected serially to one another, and other said light emitting device groups;

a current detecting step in which a current detecting unit detects only a current to be supplied to a said specified light emitting device group out of said plurality of light emitting device groups;

a power source controlling step in which a power source controlling unit controls said constant current circuit and said power source circuit based on a current detected by said current detecting unit and a current set in advance so that said forward voltage is applied to said specified light emitting device group; and a chromaticity adjusting step in which a chromaticity adjusting unit adjusts chromaticity of illuminating light emitted from said light source, wherein said power source controlling step comprises:

a step in which an oscillator generates a triangular wave signal having a specified period and amplitude, a step in which a comparator compares said triangular wave signal inputted from said oscillator with a detecting signal corresponding to a current detected by said current detecting unit and outputs a high-level or low level signal according to magnitude of said triangular wave signal and said detecting signal, thereby controlling said power source circuit, a step in which a current value adjusting section determines a set value of a current to be supplied to said specified light emitting device group, and a step in which a current value setting section controls said constant current circuit and said oscillator based on said set value of a current.

9. A flat illuminating device comprising:

a light source having a plurality of light emitting device groups for emitting a plurality of colored lights, connected in parallel to one another, each group comprising a plurality of light emitting devices for emitting a same colored light and being connected only serially to one another; and a light emission control circuit to drive and control said light source;

wherein said light emission control circuit comprises:

a constant current circuit connected serially to only a specified light emitting device group having a highest whole forward voltage required to obtain a specified light emission intensity, out of said plurality of light emitting device groups;

a power source circuit to apply its output voltage to said specified light emitting device group and said constant current circuit connected serially to one another, and other said light emitting device groups;

a current detecting unit to detect only a current to be supplied to said specified light emitting device group out of said plurality of light emitting device groups;

a power source controlling unit to control said constant current circuit and said power source circuit based on a current detected by said current detecting unit and a current set in advance so that said forward voltage is applied to said specified light emitting device group; and a chromaticity adjusting unit to adjust chromaticity of illuminating light emitted from said light source, wherein said power source controlling unit comprises:

an oscillator to generate a triangular wave signal having a specified period and amplitude, a comparator to compare said triangular wave signal inputted from said oscillator with a detecting signal corresponding to a current detected by said current detecting unit and to output a high-level or low level signal according to magnitude of said triangular wave signal and said detecting signal, hereby controlling said power source circuit, a current value adjusting section to determine a set value of a current to be supplied to said specified light emitting device group, and a current value setting section to control said constant current circuit and said oscillator based on said set value of a current.

10. A liquid crystal display device comprising:

a liquid crystal display panel;

a light source having a plurality of light emitting device groups for emitting a plurality of colored lights, connected in parallel to one another, each group comprising a plurality of light emitting devices for emitting a same colored light and being connected only serially to one another; and a flat illuminating device comprising a light emission control circuit to drive and control said light source;

wherein said light emission control circuit comprises:

only a constant current circuit connected serially to only a specified light emitting device group having a highest whole forward voltage required to obtain a specified light emission intensity, out of said plurality of light emitting device groups;

a power source circuit to apply its output voltage to said specified light emitting device group and said constant current circuit connected serially to one another, and other said light emitting device groups;

a current detecting unit to detect only a current to be supplied to said specified light emitting device group out of said plurality of light emitting device groups;

a power source controlling unit to control said constant current circuit and said power source circuit based on a current detected by said current detecting unit and a current set in advance so that said forward voltage is applied to said specified light emitting device group; and a chromaticity adjusting unit to adjust chromaticity of illuminating light emitted from said light source, wherein said power source controlling unit comprises:

an oscillator to generate a triangular wave signal having a specified period and amplitude, a comparator to compare said triangular wave signal inputted from said oscillator with a detecting signal corresponding to a current detected by said current detecting unit and to output a high-level or low-level signal according to magnitude of said triangular wave signal and said detecting signal, hereby controlling said power source circuit, a current value adjusting section to determine a set value of a current to be supplied to said specified light emitting device group, and a current value setting section to control said constant current circuit and said oscillator based on said set value of a current.

11. A light emission control circuit for driving and controlling a light source having a plurality of light emitting device groups for emitting a plurality of colored lights, connected in parallel to one another, each group comprising a plurality of light emitting devices for emitting a same colored light connected only serially to one another, said light emission control circuit comprising:

a constant current circuit connected serially to only a specified light emitting device group having a highest whole forward voltage required to obtain a specified light emission intensity, out of said plurality of light emitting device groups;

a power source circuit to apply its output voltage to said specified light emitting device group and said constant current circuit connected serially to one another, and other said light emitting device groups; and a power source controlling unit to control said constant current circuit and said power source circuit so that said forward voltage is applied to said specified light emitting device group, wherein said power source controlling unit comprises:

a current detecting unit to detect only a current to be supplied to said specified light emitting device group out of said plurality of light emitting device groups, an oscillator to generate a triangular wave signal having a specified period and amplitude, a comparator to compare said triangular wave signal inputted from said oscillator with a detecting signal corresponding to a current detected by said current detecting unit and to output a high-level or low-level signal according to the comparison result, and a buffer to amplify the output from said comparator and to apply the amplified output to said power source circuit, a current value adjusting section to determine a set value of a current to be supplied to said specified light emitting device group, and a current value setting section to control said constant current circuit and said oscillator based on said set value of a current.

* * * * *